US007237616B2

(12) United States Patent
Patel

(10) Patent No.: US 7,237,616 B2
(45) Date of Patent: Jul. 3, 2007

(54) ACTUATOR MODULE TO OPERATE A DOWNHOLE TOOL

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 42 days.

(21) Appl. No.: 10/414,725

(22) Filed: Apr. 16, 2003

(65) Prior Publication Data

US 2004/0026086 A1 Feb. 12, 2004

Related U.S. Application Data

(60) Provisional application No. 60/373,541, filed on Apr. 16, 2002.

(51) Int. Cl.
*E21B 23/04* (2006.01)

(52) U.S. Cl. ..... 166/381; 166/66.6; 166/66.7

(58) Field of Classification Search ..... 166/66.4, 166/66.7, 66.6, 381, 386
See application file for complete search history.

(56) References Cited

U.S. PATENT DOCUMENTS 3,264,994 A * 8/1966 Leutwyler ..... 102/206
3,503,445 A * 3/1970 Cochrum et al. ..... 166/244.1
4,796,699 A 1/1989 Upchurch
4,896,722 A 1/1990 Upchurch
4,915,168 A 4/1990 Upchurch
5,052,489 A * 10/1991 Carisella et al. ..... 166/297
5,211,224 A * 5/1993 Bouldin ..... 166/63
5,226,494 A * 7/1993 Rubbo et al. ..... 166/250.17
5,316,087 A * 5/1994 Manke et al. ..... 166/381
5,396,951 A 3/1995 Ross
5,691,712 A 11/1997 Meek et al.
5,706,896 A 1/1998 Tubel et al.
5,823,263 A * 10/1998 Morris et al. ..... 166/313
6,173,772 B1 1/2001 Vaynshteyn
6,176,318 B1 1/2001 Drakeley et al.
6,182,764 B1 2/2001 Vaynshteyn
6,298,919 B1 * 10/2001 Browne et al. ..... 166/373

FOREIGN PATENT DOCUMENTS

CA 2286014 C 10/1998
EP 0999338 A1 5/2000
GB 2277339 A 10/1994
GB 2302115 A 1/1997
GB 2374369 A 10/2002

* cited by examiner

*Primary Examiner*—William Neuder
(74) *Attorney, Agent, or Firm*—Trop, Pruner & Hu, P.C.; Dona C. Edwards; Bryan P. Galloway

(57) ABSTRACT

An actuator module that is usable with a subterranean well includes a housing, a stimulus detector and an actuator. The stimulus detector and the actuator are mounted to the housing, and the housing is adapted to form a releasable connection with a tubular string. The string has a downhole tool, and the housing is separate from the tool when the housing is connected to the string. The stimulus detector detects communication of a command-encoded stimulus downhole, and the actuator actuates the tool in response to the stimulus.

24 Claims, 8 Drawing Sheets

ACTUATOR MODULE TO OPERATE A DOWNHOLE TOOL

This application claims the benefit under 35 U.S.C. § 120 to U.S. Provisional Patent Application Ser. No. 60/373,541, filed on Apr. 16, 2002.

BACKGROUND

The invention generally relates to an actuator module to operate a downhole tool.

A testing or production system for a subterranean well may include various downhole tools that are remotely operated from the surface of the well. As examples, these tools may include a flapper valve, a ball valve, a sleeve, a packer, etc.

The downhole tool may operate in response to a fluid pressure. More specifically, a conventional pressure-operated downhole tool operates in response to a fluid pressure that exists either in a passageway of a tubing string (containing the downhole tool) or in the annulus of the well (that surrounds the tool). The fluid pressure may be a function of the weight of the column of fluid that extends to the surface of the well as well as any additional pressure that may be applied to the column from the surface of the well.

Several different pressure-operated downhole tools may be present in the well, and it may be desirable to selectively operate these tools at different times to perform different downhole functions. Different conventional techniques may be used to prevent a particular pressure-operated downhole device from operating until desired. For example, each pressure-operated downhole tool may respond only when the fluid pressure exceeds a particular pressure level. Thus, one particular downhole tool may only respond to the fluid pressure when the pressure exceeds some predetermined threshold, another downhole tool may respond when the fluid pressure exceeds a higher predetermined threshold, etc.

To achieve this type of pressure sensitive operation, a particular downhole tool may include a rupture disc to establish a barrier between the fluid pressure (present in a passageway of a tubing string or in an annulus of the well) and a piston head of an operator mandrel of the tool. When the fluid pressure exceeds a predetermined level, the rupture disc ruptures to permit the fluid pressure to act on the piston head to move the operator mandrel to actuate the downhole tool.

A potential challenge associated with the above-described control scheme is that the number of pressure-operated downhole tools in a particular well may be limited due to the limitations on the tubing pressure rating or surface pressure.

Another control scheme for selectively controlling downhole tools includes the communication of pressure pulses downhole. The identification of a particular downhole tool as well as a command (an "open valve" command, for example) for that tool may be encoded in these pressure pulses. A binary pattern of high and low pressure pulses may be used to distinguish a particular command or uniquely identify a particular downhole tool, as compared to controlling the tools using different pressure levels. Therefore, the pressure pulse-type control scheme remains within pressure ratings regardless of the number of downhole tools. However, a potential challenge with this arrangement is that downhole tools that decode and respond to the pressure pulses typically may be complex in design and are relatively expensive to make. Tools having other types of remote actuation (e.g., acoustic actuation) suffer from similar challenges.

Thus, there is a continuing need for an arrangement and/or technique that addresses one or more of the problems that are set forth above as well as possibly address one or more additional or different problems that are not set forth above.

SUMMARY

In an embodiment of the invention, an actuator module that is usable with a subterranean well includes a housing, a stimulus detector and an actuator. The stimulus detector and the actuator are mounted to the housing, and the housing is adapted to form a releasable connection with a tubular string. The string has a downhole tool, and the housing is separate from the tool when the housing is connected to the string. The stimulus detector detects communication of a command-encoded stimulus downhole, and the actuator actuates the tool in response to the stimulus.

In another embodiment of the invention, an apparatus that is usable with a subterranean well includes a detector and an actuator. The detector detects communication of a command-encoded stimulus downhole, and the actuator activates a pressure generating medium to actuate a downhole tool in response to the detection of the stimulus.

Advantages and other features of the invention will become apparent from the following description, drawing and claims.

DETAILED DESCRIPTION

Figure 1:
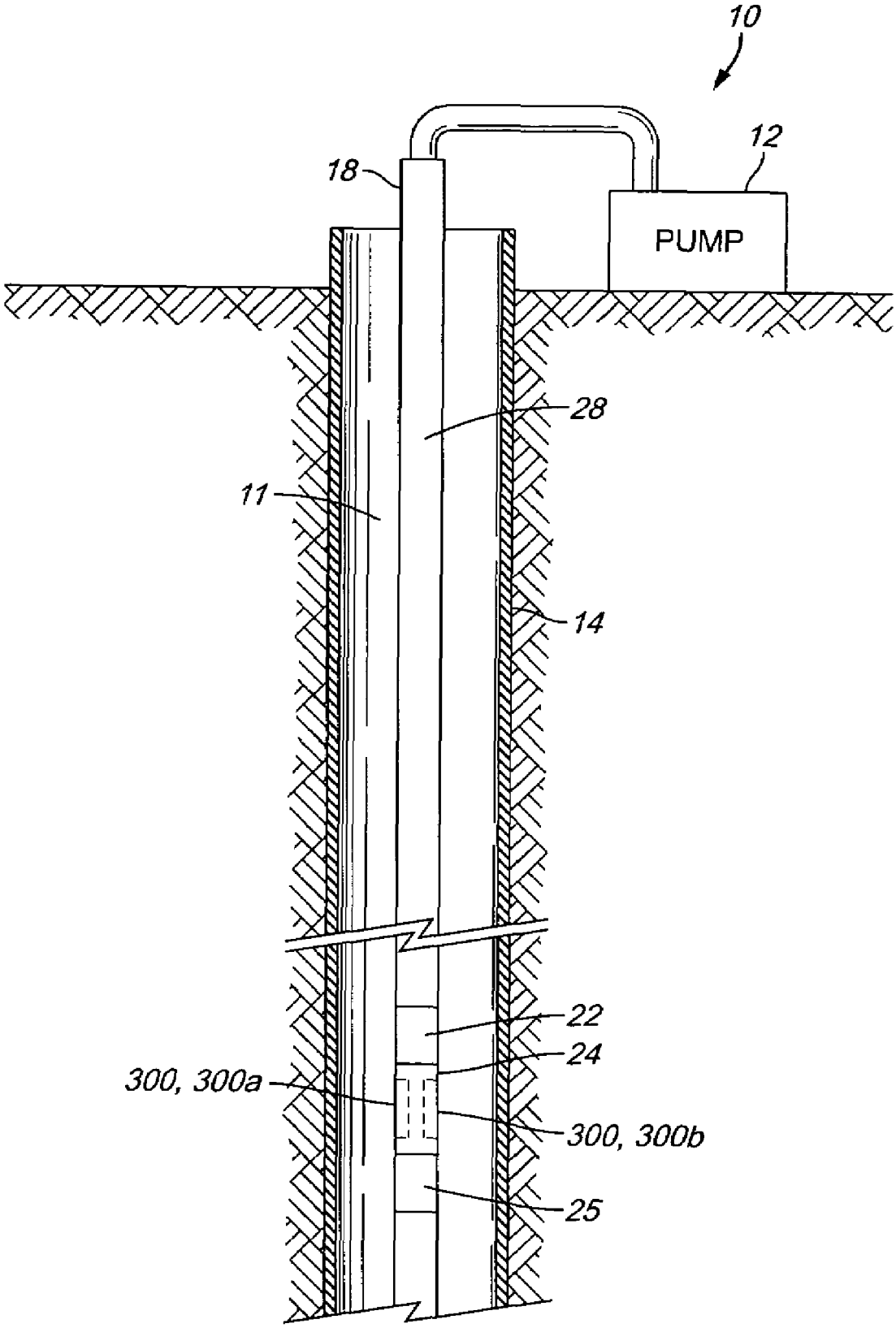
FIG. 1 is a schematic diagram of a subterranean well system according to an embodiment of the invention.

Referring to FIG. 1, an embodiment of a subterranean well system 10 includes a tubular string 18 that extends into a subterranean well. As an example, the string 18 may be used for purposes of producing well fluids from one or more formations of the well. Alternatively, the string 18 may be used for another purpose, such as performing tests in the well. The string 18 may include, for example, an upper 22 and a lower 25 downhole tool that may be used to perform various possible downhole functions. As examples, the tool 22, 25 may be a flapper valve, a ball valve, a sleeve valve, a circulation valve, a packer, etc. As depicted in FIG. 1, in addition to the string 18, the system 10 includes a well casing string 14 that lines a wellbore into which the string 18 extends.

Fluid inside an annulus 11 or inside a central passageway 28 of the well may serve as a medium for propagating pressure-encoded stimuli from the surface of the well down to a region near the tools 22 and 25 for purposes of controlling operations of the tools. These pressure pulses may be created by a fluid pump 12 that is located at the surface of the well. Alternatively, fluid that exists inside the central passageway 28 or annulus 11 may serve as a medium for propagating the command-encoded stimuli downhole.

The tools 22 and 25, however, may be incapable by themselves to respond to the command-encoded pressure pulses. Instead, in some embodiments of the invention, each tool 22, 25 is a pressure-operated tool that is actuated when an operator mandrel of the tool 22, 25 moves (i.e., is "actuated") in direct response to an applied pressure that appears on a pressure inlet port (not shown in FIG. 1) of the tool 22, 25. As examples, the source of this fluid pressure may be fluid that exists either in the central passageway 28 of the string 18 or in the annulus 11 of the well.

Although neither tool 22, 25 has the ability to directly respond to a command-encoded stimuli (a series of pressure pulses, for example) that are communicated from the surface of the well, the string 18 includes actuator modules 300 (actuator modules 300*a* and 300*b*, depicted as examples) that decode these stimuli and selectively control operations of the tools 22 and 25 in response to these stimuli. More specifically, in some embodiments of the invention, the actuator module 300*a* controls communication of fluid pressure to the pressure inlet port of the upper tool 22, and the actuator module 300*b* controls communication of fluid pressure to the pressure inlet port of the lower tool 25 and 25. In the description of the actuator modules 300*a* and 300*b* herein, the reference numeral "300" refers to the design of each actuator module 300*a*, 300*b* shared in common.

In some embodiments of the invention, the actuator modules 300 are separate from either tool 22, 25, and each module 300 is constructed to be releasably connected to the string 18. The actuator modules 300 are generally not specifically designed for any particular tool (although they could be, in some embodiments of the invention) so that a particular module 300 may be used with any pressure-operated tool for purposes of converting that tool into a tool that may be remotely controlled from the surface via command-encoded stimuli.

In some embodiments of the invention, the actuator modules 300*a* and 300*b* may be installed in a carrier housing assembly 24, a portion of the string 18 that includes fluid communication paths between the actuator modules 300*a* and 300*b* and the tools 22 and 25.

By default, the actuator module 300 isolates the pressure inlet ports of the associated tool (i.e., the upper tool 22 for the actuator module 300*a* and the lower tool 25 for the actuator module 300*b*) from fluid pressure to maintain the tool in its non-actuated state. However, in response to detecting a command for the associated tool (encoded in the stimuli), the actuator module 300 opens communication to the pressure inlet port of the associated tool so that fluid pressure (in the central passageway 28 or annulus 11) causes actuation of the tool.

As a more specific example, the actuator module 300*a*, may by default, isolate the pressure inlet port of the upper tool 22 from a column of fluid that is present inside a central passageway of the string 18. The actuator module 300*a* monitors this fluid for pressure pulses. A series of pressure pulses may then be communicated downhole for purposes of uniquely identifying, or addressing, the upper tool 22. The actuator module 300*a* decodes this sequence of pressure pulses to determine that a command for the upper tool 22 is forthcoming. One or more additional pressure pulses may follow the first series of pressure pulses to indicate a command (an "open valve" command or a "close valve" command, as examples) for the upper tool 22. In response to decoding the command, the actuator module 300*a* may then permit communication between the pressure inlet port of the upper tool 22 and the column of fluid to cause actuation of the upper tool 22. More specifically, in response to fluid from the central passageway entering the pressure inlet port of the upper tool 22, pressure may be exerted on a piston head of an operator mandrel of the upper tool 22 to cause the tool 22 to perform some downhole function.

It is noted that the example given above is just one out of many possible scenarios for addressing and communicating a command to a downhole tool. For example, in some embodiments of the invention, a particular stimulus may encode a command and the identification of a tool together. As another example, in some embodiments of the invention, non-fluid command-encoding stimuli may be communicated downhole. For example, in some embodiments of the invention, command-encoded stimuli may be communicated downhole by way of acoustic waves that propagate downhole via the tubing wall of the string 18 or other well component. The acoustic-conveyed and fluid-conveyed stimuli are examples of wireless stimuli (i.e., stimuli that are not communicated downhole on a wireline, cable or other electrical wire) that may be communicated downhole for purposes of operating a downhole tool. Other types of stimuli and other types of encoding commands in these stimuli are possible and are within the scope of the appended claims.

Regardless of the type of stimuli that are communicated downhole or the manner in which commands are encoded in these stimuli, the actuator module 300 provides an intermediary function of decoding these stimuli and controlling one or more downhole tools that are otherwise incapable of responding to these stimuli. In some embodiments of the invention, the actuator module 300 is a self-contained unit that may be used with a wide variety of pressure-operated downhole tools. More specifically, the actuator module 300 may be assembled to a particular string to convert a tool of the string into a remotely actuated tool. Thus, a particular downhole tool does not need to be designed to decode and operate in response to command-encoded stimuli. Instead, the tool may have a much simpler design in that the tool may be designed to operate in response to a fluid pressure level; and if remote operation of the tool via command-encoded stimuli is desired, the actuator module 300 may be assembled on a particular string along with that tool.

The actuator module 300, in some embodiments of the invention, permits the addition of control functions that are specific to a particular well. Thus, the actuator module 300 permits control adaptation that is specific to a particular environment without requiring direct modification of the tool for this environment. For example, in some embodiments of the invention, the actuator module 300 may be used in an open hole completion, i.e., a completion in which no plugs or other seals exist for purposes of building up a fluid pressure (hydrostatic or otherwise) in the tubing or annulus to operate a downhole tool. For this scenario, in some embodiments of the invention, the actuator module 300 may include a sufficient propellant or similar pressure generating medium that ignites or expands when heated to supply the force needed to actuate an associated downhole tool, as described further below. Alternatively, in some embodiments of the invention, the actuator module 300 may include a gas spring or other source of stored energy.

Turning now to a more detailed example of an embodiment of the string 18, FIGS. 2, 3, 4 and 5 depict consecutive sections 18A, 18B, 18C, 18D and 18E, respectively, of the string 18. Section 18A is the uppermost tubing section that is depicted in these figures, and section 18E is the lowermost tubing section that is depicted in these figures.

Figure 2:
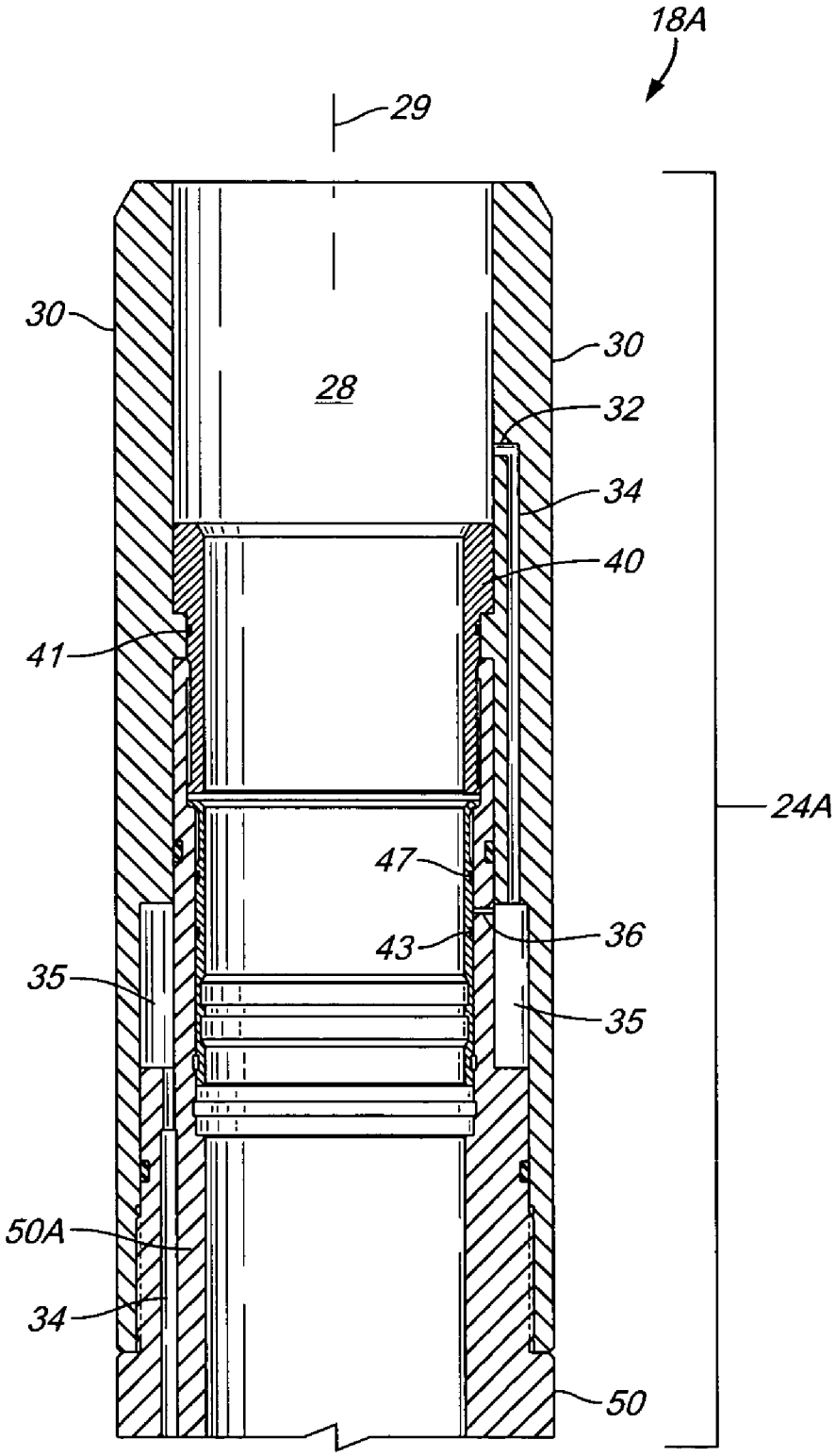
FIGS. 2, 3, 4, 5 and 6 are schematic diagrams of different portions of a tubular string of the system of FIG. 1 according to an embodiment of the invention.

FIG. 2 is the tubing section 18A that contains an uppermost section 24A of the carrier housing assembly 24 according to an embodiment of the invention. This section 24A establishes a communication passageway for linking the actuator module 300*a* to the upper tool 22. As shown, the section 24A includes an upper housing section 30 that is generally coaxial with a longitudinal axis 29 of the string 18 and circumscribes a central passageway 28 of the string 18. The lower end of the upper housing section 30 is concentric with and is connected to (threadably connected to, for example) an intermediate housing section 50. Seals are formed between the two housing sections 30 and 50.

The upper housing section 30 includes a longitudinal communication path 34 that is capable of communicating fluid for purposes of exerting pressure on a pressure inlet port (not shown) of the upper tool 22 to actuate an operator mandrel of the upper tool 22. The pressure inlet port of the upper tool 22 is connected to an outlet port 32 of the communication path 34; and the actuator module 300*a* (not shown in FIG. 2) controls fluid flow through the communication path 34, as described in more detail below. Due to this arrangement, when the actuator module 300*a* permits fluid to flow through the path 34, the fluid is communicated to the pressure inlet port of the upper tool 22 for purposes of acting on a piston head of an operator mandrel of the upper tool 22 to perform some tool function. Not shown in FIG. 2 are the components of the upper tool 22 that are connected to operate from this port 32.

As described below, in some embodiments of the invention, the fluid (and thus, the fluid pressure) to control the upper 22 and lower 25 tools is the fluid inside the central passageway 28 of the string 18. Thus, the actuator module 300*a* controls the communication of fluid between the passageway 28 and the communication path 34 so that the actuator module 300*a* controls when tubing pressure appears at the outlet port 32. As described herein, the actions of the actuator module 300*a* may be controlled via command-encoded stimuli that are communicated downhole. However, in some embodiments of the invention, the actuator module 40 includes a mechanical mechanism that may be used to bypass this remote control for purposes of mechanically actuating the tool.

More specifically, in some embodiments of the invention, the carrier housing assembly 24 may include a sleeve 40 that is circumscribed by the housing section 30 and is coaxial with the longitudinal axis 29 of the string 18. The interior surface of the sleeve 40 has a profile that may be engaged by a shifting tool. By default, the sleeve 40 covers a radial port 36 (in the housing section 50) that establishes communication between the central passageway 28 and the communication path 34. O-rings 43 and 47 are located above and below the port 36. More specifically, these o-rings 43 and 47 are located in exterior annular grooves of the sleeve 40 and circumscribe the sleeve 40 to form seals between the exterior surface of the sleeve 40 and the interior surface of the intermediate housing section 50. These seals, in turn, isolate the central passageway 28 of the string from the communication path 34 when the sleeve 40 is in its default position.

However, a shifting tool may be inserted into the central passageway 28 to engage the inner profile of the sleeve 40 for purposes of moving the sleeve 40 in an upward direction. When this occurs, the O-rings 41 and 43 no longer seal off fluid communication between the passageway 28 and the communication path 34 (and thus, the pressure inlet port of the upper tool 22). Thus, the shifting tool may be used to engage and move the sleeve 40 for purposes of actuating the upper tool 22.

As depicted in FIG. 2, in some embodiments of the invention, the communication path 34 may be routed on different sides of the tool 22. In this manner, as depicted in FIG. 2, the communication path 34 depicted on the right-hand side of FIG. 2 is linked to a lower communication path 34 located on the left-hand side of FIG. 2 by an annular chamber 35. This annular chamber 35 may be formed between the exterior surface of the intermediate housing section 50 and the interior surface of the upper housing section 30.

Figure 3:
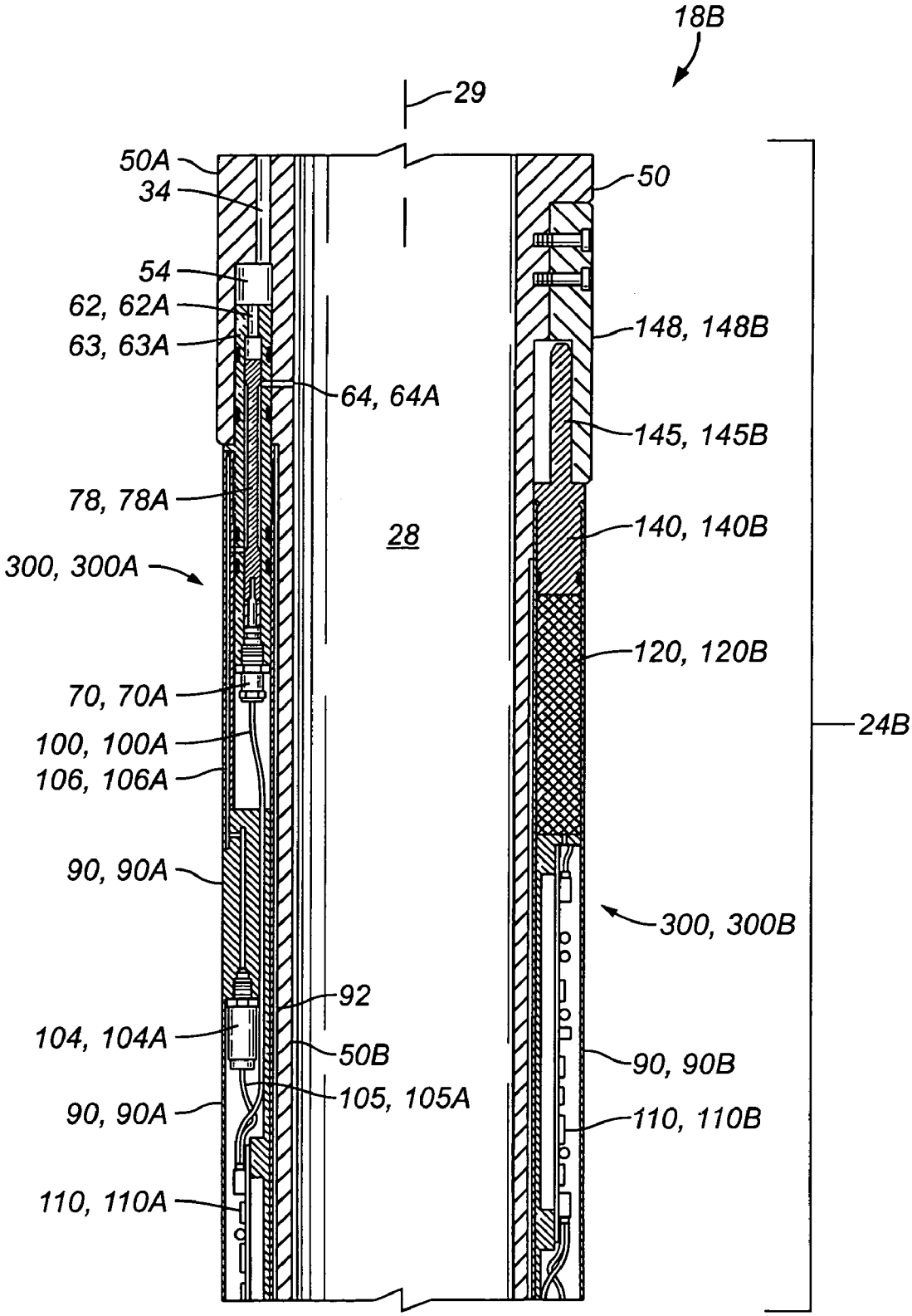
Figure 4:
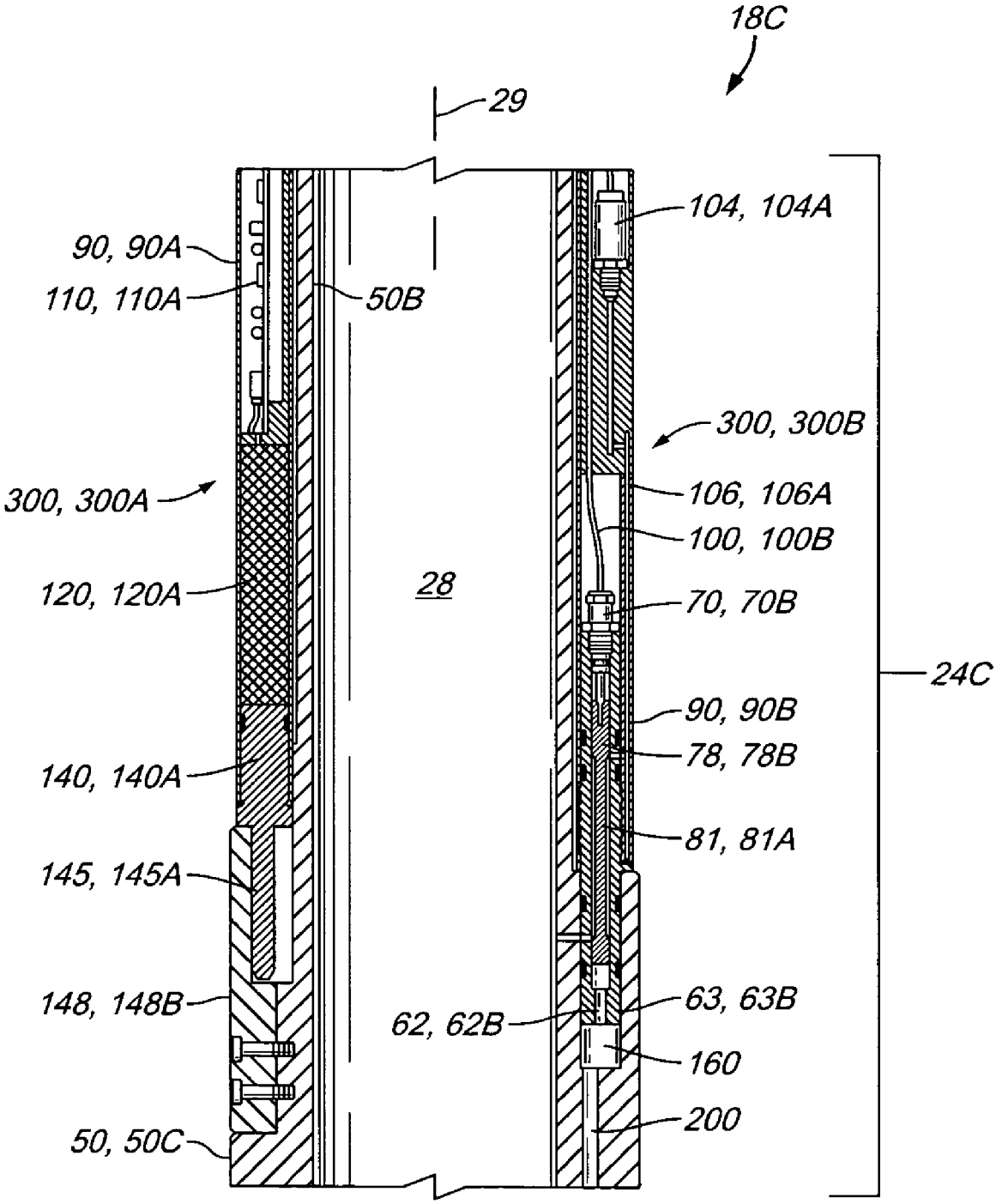

FIG. 3 depicts a section 24B of the carrier housing assembly 24, just below the section 24B section 24A. FIG. 4 depicts the next lower section 24C of the carrier housing assembly 24. More specifically, FIGS. 3 and 4 depict portions of the two actuator modules 300*a* and 300*b*. The actuator modules 300*a* and 300*b* are generally located in the same longitudinal position along the string 18. However, the actuator module 300*a* is rotated 180 degrees with respect to the actuator module 300*b*, so that each actuator modules 300 is oriented in the appropriate position for controlling the associated tool 22, 25. Each actuator module 300 partially circumscribes the longitudinal axis 29 of the string 18, and the actuators 300 general reside in an annular cavity 92 formed in the intermediate housing section 50. More particularly, the annular cavity 92 circumscribes a radially thinner portion 50B of the intermediate housing section 50; and the annular cavity 92 is located between two radially thicker portions 50A and 50B of the intermediate housing section 50.

In the following description, common reference numerals are used to discuss components that the actuator modules 300*a* and 300*b* share in common. A specific reference to a component of the actuator module 300*a* is made using the suffix "a," and a specific reference to a component of the actuator module 300*b* is made using the suffix "b." Thus, as an example, the reference numeral "70" refers to a propellant cartridge of either actuator module 300. The reference numeral "70*a*" refers to the propellant cartridge of the actuator module 300*a*, and the reference numeral "70*b*" refers to the propellant cartridge of the actuator module 300*b*.

Referring to FIGS. 3 and 4, the actuator module 300*a*, in some embodiments of the invention, is effectively a particular annular cartridge that conforms to the curved contour of the annular cavity 92. Thus, the housing of the actuator module 300 conforms to the current contour of the annular cavity 92 so that the housing fits inside the cavity 92 and partially circumscribes the longitudinal axis 29. Thus, the housing of the actuator module 300 is constructed to form a releasable connection with the string 18 in that the module 300 may be inserted into the cavity 92, and then secured in place, the module 300 may be removed in a similar manner. Furthermore, the module 300 is separate from either downhole tool 22 or 26 tool 22 or 25.

The housing of the actuator module is formed from an upper housing section 63*a* (FIG. 3), a middle housing section 90*a* and a lower housing section 140*a* that are sealably connected together. The upper housing section 63*a* has an upper outlet port 62*a* that communicates fluid from the central passageway 28 for purposes of actuating the upper tool 22. The upper housing section 63*a* is constructed to be inserted into a chamber 54 that is formed in the portion 50A of the housing section 50. This chamber 54, in turn, is in communication with the communication path 34. O-rings reside in annular grooves that are formed in the exterior surface of the upper housing section 50*a* for purposes of forming a seal between the outlet port 62*a* and the chamber 54.

The housing section 63*b* (effectively being the lower housing section given the orientation of the module 300*b* depicted in the figures) of the actuator module 300*b* is likewise constructed to be inserted into a chamber 160 (FIG. 4) that is communication with a communication path 200 that extends to the lower tool 25.

Figure 7:
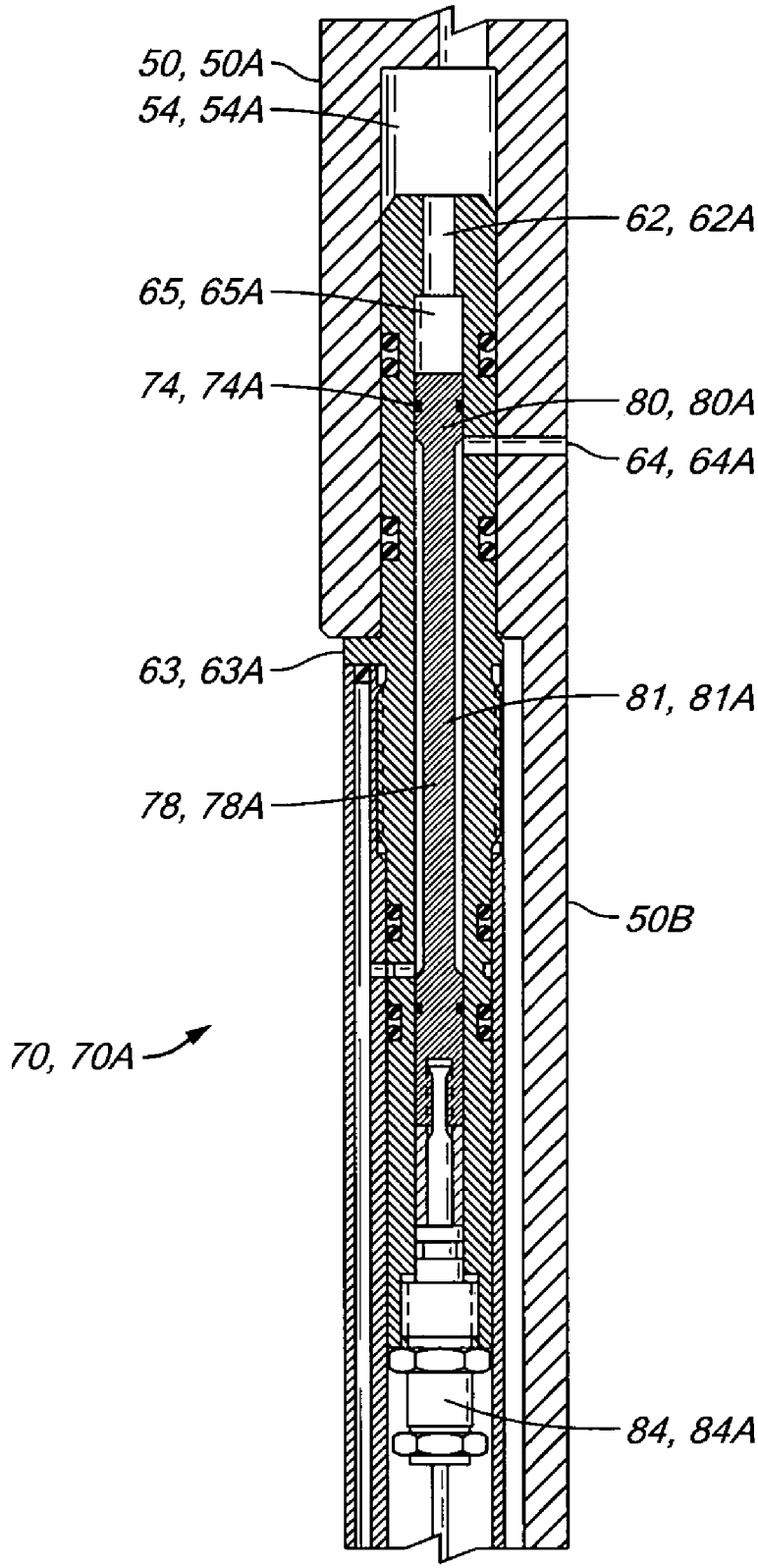
FIG. 7 is a more detailed schematic diagram of a propellant cartridge of a modular actuator of the tubular string according to an embodiment of the invention.

Each actuator module 300 includes a propellant cartridge 70, a mechanism that includes a piston assembly 78 that the cartridge 70 drives for purposes of controlling communication between a radial port 64 that opens into the central passageway 28 and the outlet port 62. Referring to FIG. 7 that depicts a more detailed schematic diagram of the cartridge 70*a*, the housing section 63 includes a radial opening that aligns with a corresponding radial opening in the portion 50B of the housing section 50 to form the radial port 64. The piston assembly 78 moves inside a chamber 65 that is circumscribed by the housing section 63. The chamber 65, in turn, opens into the outlet 62.

The piston assembly 78 includes a piston head 80 that controls communication between the radial port 64 and the outlet port 62. In this manner, an O-ring 74 is located in an exterior groove of the piston head 80 between the port 64 and the outlet 62. The O-ring 74 forms a seal between the piston head 80 and the interior surface of the housing section 63. Thus, in its default position (depicted in FIG. 7), the piston head 80 seals off communication between the radial 64 and outlet 62 ports.

The piston head 80 is connected to a stem 81 (of the piston assembly 78) that extends inside a propellant assembly 84 of the cartridge 70. The actuator module 300 activates the propellant assembly 84 when actuation of the associated tool is desired. When activated, the propellant assembly 84 moves the piston assembly 78 to retract the seal formed by the piston head 80 to a position in which the piston head 80 no longer seals off communication between the radial 64 and outlet 62 ports.

As a more specific example, when the propellant assembly 80*a* (depicted in FIG. 7) is activated, the assembly 80*a* moves the piston assembly 78*a* to a position in which the o-ring 74 is below the radial port 64.

Figure 8:
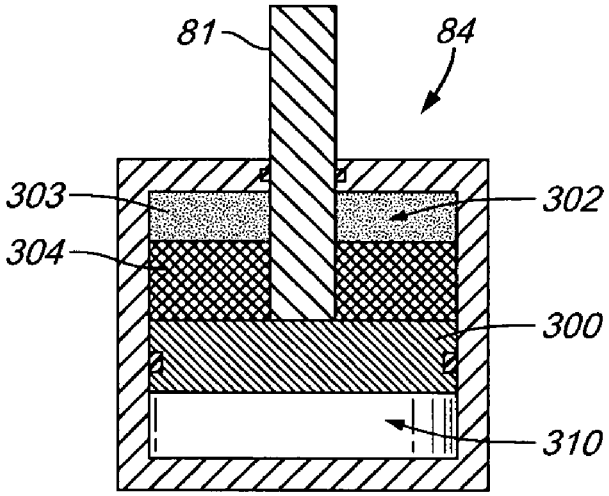
FIG. 8 is a more detailed schematic diagram of a propellant assembly of FIG. 7 according to an embodiment of the invention.

FIG. 8 depicts a more detailed schematic diagram of the propellant assembly 84. As shown, the stem 81 of the piston assembly 78 extends into an opening in a housing 301 of the assembly 84 and is connected at its lower end to a piston head 300. The piston head 300 defines a first chamber 302 (above the piston head 300) and a second chamber (below the piston head 300) inside the housing 301. The assembly 84 includes a propellant 304 that is located in the first chamber 302, along with an ignition device 303. The second chamber 310 may be at atmospheric pressure. Due to this arrangement, when the propellant 304 ignites (via a current that is applied to the ignition device 303), the propellant 304 burns to produce gases inside the first chamber 302. These gases, in turn, force the piston head 300 in a downward direction and therefore, force the stem 81 (and piston assembly 78) in a downward direction to permit communication between the radial 64 (FIG. 7) and outlet 62 ports.

In some embodiments of the invention, the chamber 302 is in communication with the communication path 34 so that the gases from the ignition of the propellant may act on the operator mandrel of the upper tool 22. In this manner, in some embodiments of the invention, the propellant produces a sufficient force to actuate the tool without completely relying on fluid pressure from the annulus or central passageway. Such an arrangement may be advantageous for purposes of operating a tool in an open bore completion.

Referring back to FIG. 3, the ignition of the propellant inside the cartridge 70, and thus, the action of the cartridge 70 is controlled by electronics 110 of the actuator module 300. More specifically, wires 100 extend between the cartridge 70 and the electronics 110. The electronics 110 is also connected to a pressure transducer 104 that is in communication (via communication path 106) to the central passageway 28 of the string 18. The electronics 110 monitors the pressure (via the transducer 104) inside the passageway 28 to detect a command stimulus that is transmitted from the surface of the well. Thus, in some embodiments of the invention, the electronics 110 monitors the pressure to detect and decode any command-encoded stimuli that appear in the fluid inside the central passageway 28.

As a more specific example, when the electronics 110*a* detects a command for the upper tool 22, the electronics 110*a* sends an electrical current to the cartridge 70*a* so that the cartridge 70*a* opens communication between the central passageway 28 and the communication path 34 for purposes of actuating the upper tool 22. Likewise, when the electronics 110*b* detects a command for the lower tool 25, the electronics 110*b* activates the cartridge 70*b* to establish communication between the central passageway 28 and the communication path 200.

In some embodiments of the invention, the pressure transducer 104 senses pressure in the well annulus, instead of pressure in the central passageway 28. Therefore, in these embodiments of the invention, the pressure commands are transmitted down the annulus of the well instead of through the tubing. In other embodiments of the invention, the pressure transducer 104 may be replaced with another type of transducer, such as a transducer to detect an acoustic wave that propagates along the tubing string 18 for purposes of communicating the downhole command. Other variations are possible.

In some embodiments of the invention, the pressure in the tubing or annulus does not actuate the particular tool. In this manner, a string 18 may be located in an open hole arrangement in which sufficient hydrostatic pressure does not exist to operate the tool. For these embodiments of the invention, the cartridge 70 may be replaced with a cartridge that has a sufficient amount of propellant to produce gas that delivers a sufficient force at the outlet port 62 to move a particular operator mandrel without requiring assistance by pressure that is exerted by fluid in the central passageway 28 or annulus. Many other variations are possible, depending on the particular embodiment of the invention.

Referring to FIG. 4, among the other features of the actuator module 300, in some embodiments of the invention, the module 300 includes a battery 120 for purposes of providing power to the circuit 110, as well as providing the power to activate the cartridge 70. In some embodiments of the invention, the electronics 110 may activate a switch (not shown) (a relay switch, for example) for purposes of draining the battery 120 after the activation of a particular tool for purposes of preventing later inadvertent operation of the tool. The housing section 140 of the actuator module 300, may, in some embodiments of the invention, form a projection 145 on one end of the module 300 for purposes of securing the module in place. In this manner, the projection 145 extends into the annular cavity 92 so that an outside curved plate 148 that circumscribes the projection 145 may be secured to the housing section 50B for purposes of locking one end of the actuator module 300 in place. The other end of the actuator module 300 extends either into the cavity 54 (for the actuator module 300*a*) or the cavity 160 (for the actuator module 300*b*).

Figure 5:
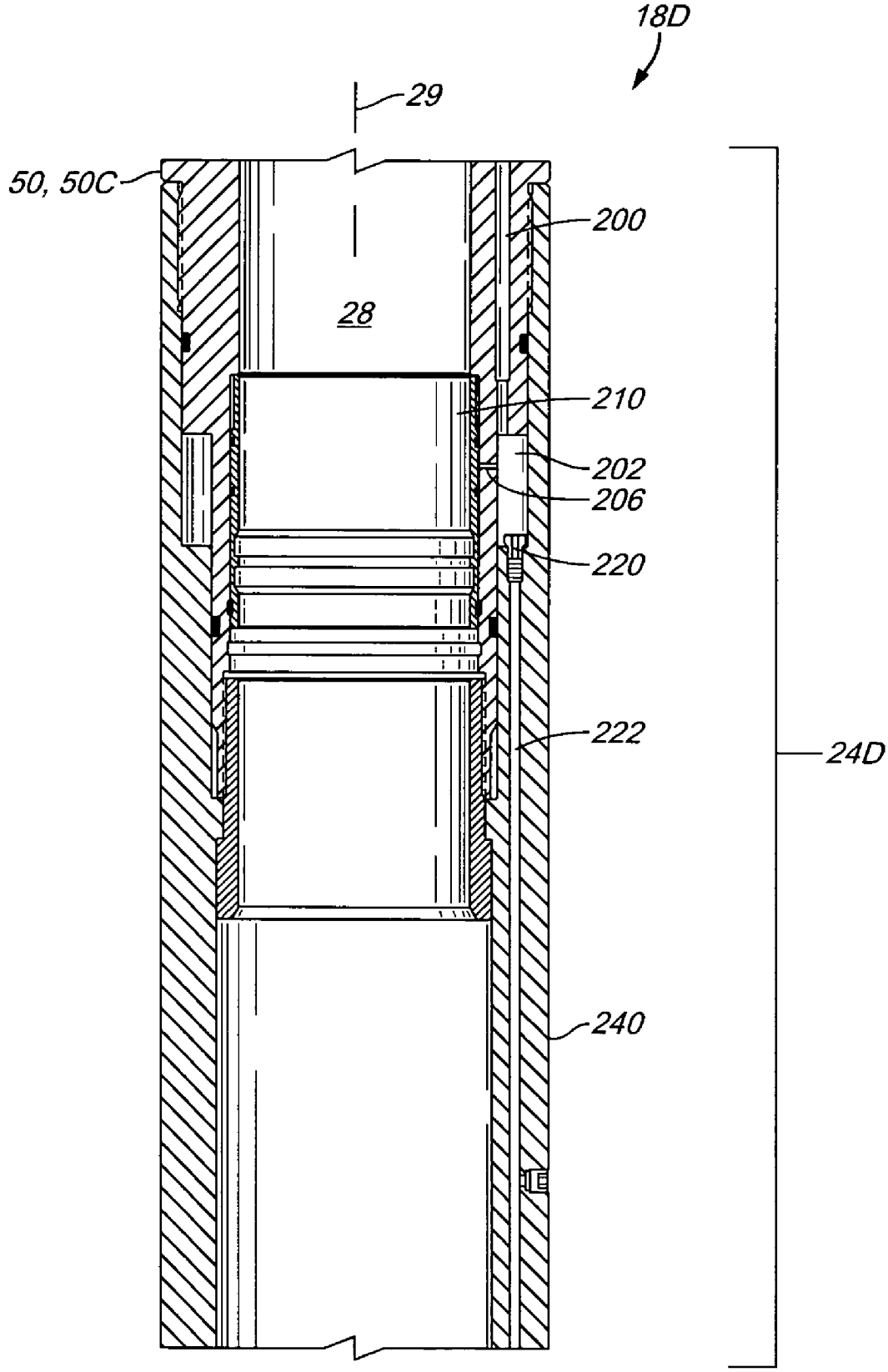

FIG. 5 depicts the lowest section 24D of the carrier housing. This section 24D forms an interface between the actuator module 300*b* and the lower tool 25. As shown, the communication path 200 opens into an annular chamber 202 that is formed where the housing section 50 is connected to a lower concentric housing section 240. A radial port 206 is located in the interior wall of the housing section 50 for purposes of forming communication between the chamber 202 and the passageway 28. However, an inner sleeve 210 blocks this communication. The sleeve 210 has an inner profile that may be engaged by a shifting tool for purposes of sliding the tool 210 to permit communication between the passageway 222 and 28, in a similar fashion to the use of the sleeve 40, discussed above.

The passageway 200 communicates with a longitudinal passageway 222 that is formed in the housing section 240. This passageway 222 extends to an operator mandrel of the lower tool 25. In some embodiments of the invention, the carrier housing assembly 24 may include a flow restrictor 220 that is located in line with the communication path 222 for purposes of metering the flow to restrict operation of the operator mandrel of the lower tool 25.

Figure 6:
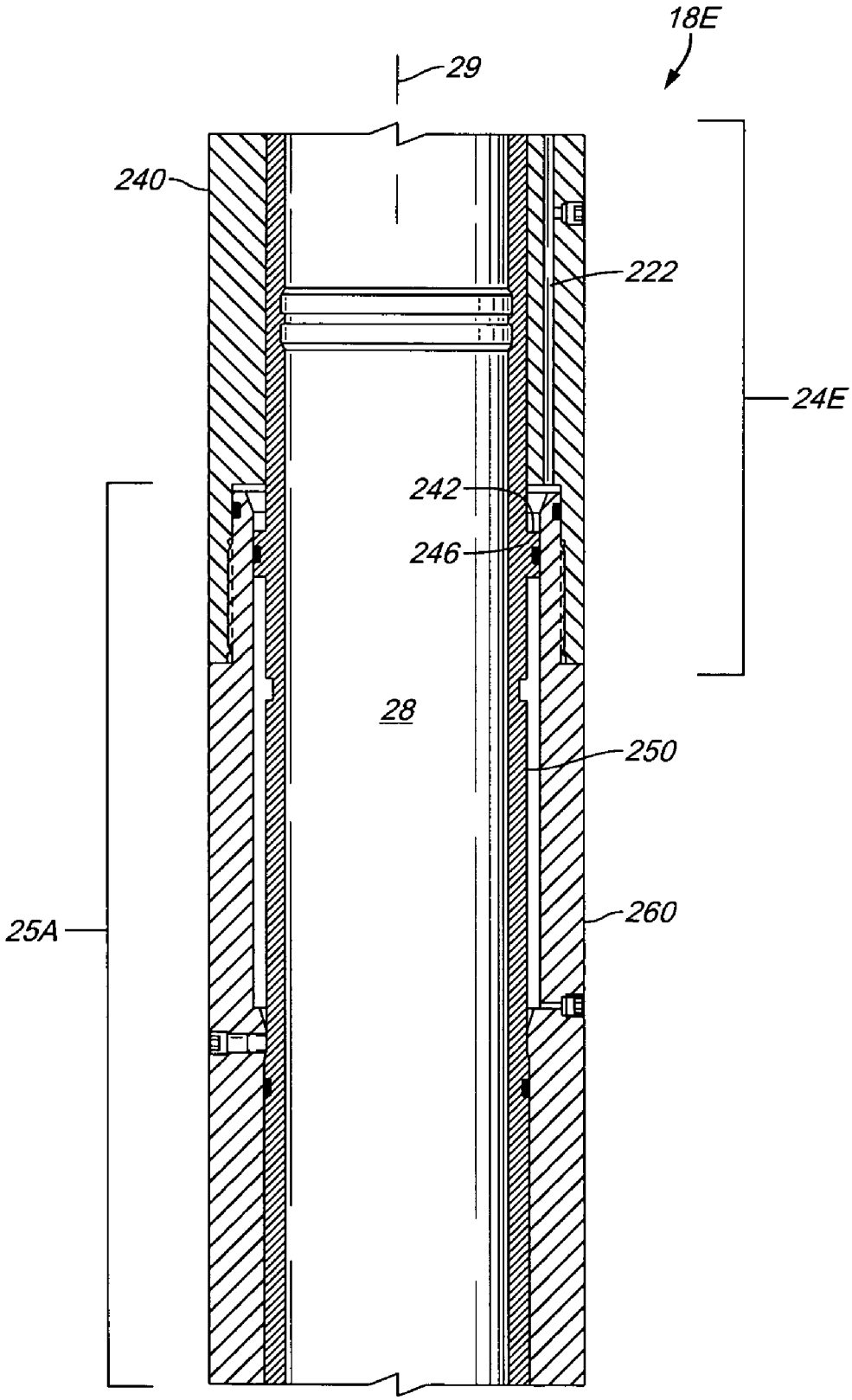

FIG. 6 depicts the interface between the communication path 222 and an operator mandrel 250 of the lower tool 25. As an example, the operator mandrel 250 may be a flow tube of a flapper valve, a sleeve of a particular circulation valve, etc. As shown, the operator mandrel 250 includes a piston head 246 that has an upper surface 242 in communication with the communication path 222. Therefore, when the actuator module 300*b* opens communication through the port 64*b* (or alternatively, when the sleeve 210 is moved), pressure is applied to the upper surface 242 to move the operator mandrel 250. Other variations are possible.

Thus, to summarize operation of the actuator module 300 according to some embodiments of the invention, the actuator module 300 includes a pressure transducer 104 that indicates the pressure of fluid in the central passageway 28. The electronics 110 is coupled to the pressure transducer 104 to monitor this pressure and decode commands and tool identifications from any detected pressure pulses. In response to detecting a command that directs actuation of the tool that is associated with the actuator module 300, the module 300 communicates a current through the propellant cartridge 70 to ignite the propellant inside the cartridge 70 to cause the piston assembly 78 to move. This movement of the piston assembly 78, in turn, permits communication between the ports 62 and 64 to allow fluid pressure for the passageway 28 to act on an operator mandrel of the tool. Other variations are possible.

Figure 9:
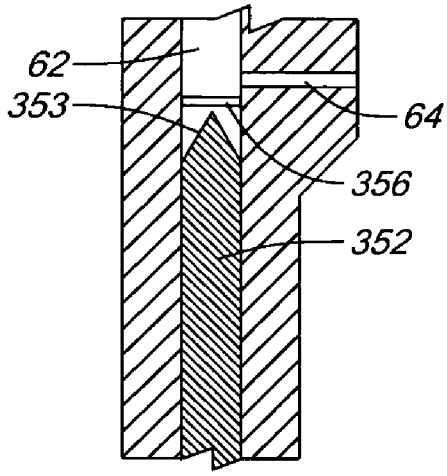
FIG. 9 is a schematic diagram of a mandrel of a modular actuator according to another embodiment of the invention.

Other embodiments are within the scope of the following claims. For example, FIG. 9 depicts an alternative arrangement for the cartridge 70 in which the piston head 80 is replaced with a piston head 352. The piston head 352 may, in some embodiments of the invention, be connected to a solenoid valve (instead of to the cartridge 70) so that the piston head 352 slides in or out upon excitation of the solenoid valve.

The piston head 352 slides in the chamber 65. However, unlike the piston head of the cartridge 70, the piston head 352 has a spear-shaped upper surface 353 that, when the piston is moved in the appropriate direction, punctures a rupture disc 356 that isolates the radial 64 and outlet 62 ports. Thus, as an example, the piston head 352 may be moved in a direction to puncture the rupture disc 356 for purposes of allowing communication between the radial 64 and outlet 62 ports. It is noted that for this embodiment, the piston head 352 may move in an opposite direction than the piston head of the previously described cartridge 70 when the actuator module 300 actuates the associated tool. Thus, for this arrangement, the propellant-containing and atmospheric chambers may be juxtaposed inside the propellant assembly 84.

As an example of another embodiment of the invention, two or more actuator modules may be redundant for a particular tool. Thus, these actuator modules provide a redundant control in that if one of the modules should fail, a circuit activates one of the remaining actuator(s) to control the tool.

The embodiments described above describe operations for a single shot tool (i.e., a tool that is operated for purposes of placing the tool in a particular state (an open state, for example) in a particular direction). However, it is noted that the principals described herein may be applied to multiple shot devices. In this manner, a particular actuator module 300 may be activated for purposes of directing an operator mandrel in one direction, and another actuator module 300 may be actuated for purposes of directing the operator mandrel in another direction. Thus, by way of example, one actuator module 300 may be used for purposes of opening a valve (for example), and another actuator module may be used for purposes of closing the valve.

Figure 10:
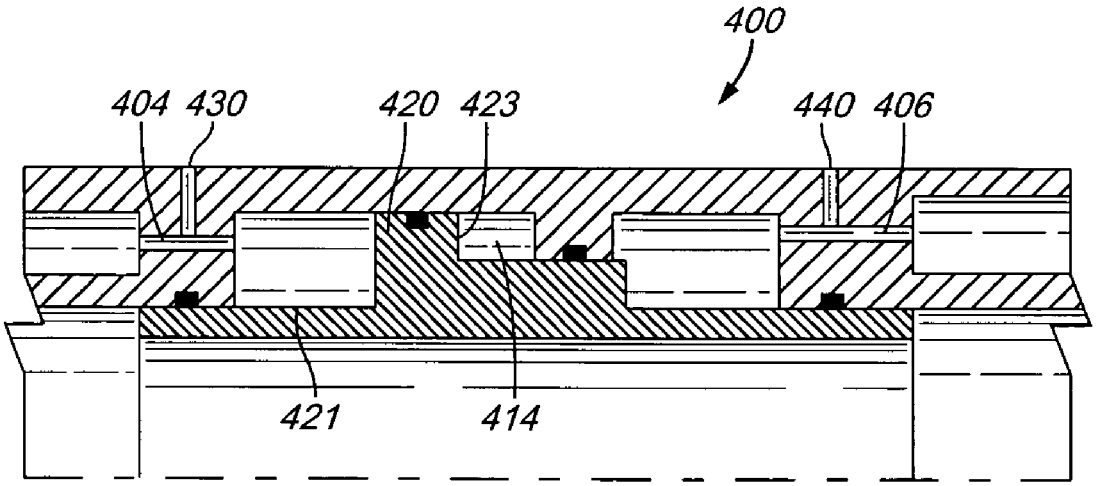
FIG. 10 is a schematic diagram of an operator mandrel of a downhole tool according to another embodiment of the invention.

FIG. 10 depicts an arrangement 400 that may be used in some implementations of the above-described multiple shot tools. In this manner, the arrangement 400 includes an operator mandrel 310 that may be moved in one direction for purposes of opening a valve (as an example) and in another direction for purposes of closing the valve (as examples). For example, the arrangement 400 may include a communication path 406 in communication with a particular actuator module. As shown, the path 406 may be in communication with a radial path 440 that may be sealed by an internal sleeve, consistent with the arrangements described above. Thus, the communication path 406 communicates pressure in response to the actuation of a particular actuator module. Upon communication of this pressure, the pressure acts against a piston surface 423 of the operator mandrel 410 for purposes of moving the operator mandrel in a particular direction.

The arrangement 400 also includes another passageway 404 in communication with another actuator module. As shown, the passageway 404 is also in communication with a radial passageway 430 that may be blocked by an inner sleeve. Thus, when a pressure is communicated through the passageway 404, this pressure operates on a surface 421 on another piston head 420 of the operator mandrel 410. This action forces the operator mandrel in another direction. It is noted that the surfaces 423 and 421 may be of different areas allowing the dual operation of the mandrel 410. An atmospheric chamber 414 may be present between the two piston heads 420 and 440. Other variations are possible.

As examples of other embodiments of the invention, in the arrangement described above, a particular actuator module is facing in one direction and another actuator module is facing in an opposite direction. However, it is noted that in other embodiments of the invention, a particular tool string may include redundant actuators that face in the same direction. Therefore, if one of these redundant actuators fails, another actuator may be used in its place.

As an example of another embodiment of the invention, the actuator module may control more than one downhole tool. In this manner, the actuator module may, for example, contain a propellant cartridge and associated piston assembly for each downhole tool that is actuated by the actuator module. Separate communication paths in the carrier housing extend from the actuator module to the various tools.

In some embodiments of the invention, the propellant of the propellant cartridge may be replaced by another pressure generating medium. For example, in some embodiments of the invention, the propellant may be replaced by an explosive, and this explosive may be detonated by, for example, a detonation device. Depending on the particular embodiment of the invention, the explosive moves the piston assembly to permit the communication of fluid pressure to the operator mandrel of the tool. In some embodiments of the invention, the explosive products a sufficient force that is used to drive the operator mandrel of the tool in an open bore completion.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. An actuator module usable with a tubular string adapted to be deployed in a well, the string comprising a segment to extend along a longitudinal axis of the string to connect a first portion of the string to a second portion of the string and define an annular cavity that at least partially surrounds the segment, the actuator module comprising:

a unit adapted to be installed in and removed from the annular cavity as a single piece, the unit comprising:

a housing;

a stimulus detector mounted to the housing to detect communication of a command-encoded stimulus downhole; and an actuator mounted to the housing to selectively control a tool of the string in response to the stimulus.

2. The actuator module of claim 1, wherein the stimulus comprises a wireless stimulus.

3. The actuator module of claim 1, wherein the actuator is adapted to selectively control communication of fluid pressure to a fluid control port of the tool to control actuation of the tool.

4. The actuator module of claim 1, wherein actuator comprises:

a member to selectively control communication of fluid to a fluid control port of the tool; and a cartridge comprising a pressuring generating medium to be activated in response to the detection of the stimulus to move the member to permit communication of the fluid to the fluid control port.

5. The actuator module of claim 1, wherein the tool comprises an operator mandrel and the actuator comprises:

a member; and a cartridge comprising a pressure generating medium to be activated in response to the detection of the stimulus to move the member to operate the operator mandrel.

6. The actuator module of claim 1, wherein the tool is incapable of responding to the stimulus in the absence of the actuator module.

7. The actuator module of claim 1, wherein the housing is adapted to remain substantially clear of a central passageway of the string when the housing is received in the annular cavity.

8. The actuator module of claim 1, wherein the stimulus is communicated through at least one of the following media: fluid in an annulus of the well, fluid in a passageway of a tubular string and a tubular string.

9. The actuator module of claim 1, wherein the actuator is adapted to actuate more than one tool of the string.

10. The actuator module of claim 1, wherein the unit is adapted to be installed in and retrieved from the annular cavity along a substantially radial path.

11. The actuator module of claim 1, wherein the unit further comprises a longitudinally extending projection to be at least partially surrounded by a curved plate to retain the unit in the annular cavity.

12. The actuator module of claim 1, wherein the segment is formed from a radially thinner part of a housing member and the first and second portions of the string include radially thicker parts of the housing member.

13. A method usable with a well, comprising:

providing a housing that conforms to an annular cavity of a string;

providing a controller attached to the housing to enable a tool of the string to respond to command-encoded stimuli; and installing the housing and controller as a unit in the annular cavity.

14. The method of claim 13, wherein the act of providing the controller comprises:

mounting a stimulus detector to the housing to detect a communication of the command-encoded stimuli; and mounting an actuator to the housing to actuate the tool in response to the stimuli without using a mechanical coupling between the actuator and the tool, the method further comprising:

installing the stimulus detector and actuator as part of the unit in the annular cavity.

15. The method of claim 14, further comprising:

using the actuator to control communication of fluid pressure to an inlet port of the tool to actuate the tool.

16. The method of claim 13, further comprising:

coupling the housing to multiple pressure-operated tools to upgrade the tools to respond to command-encoded stimuli.

17. The method of claim 13, further comprising:

providing another controller attached to the housing to provide a redundant system for controlling the tool.

18. The method of claim 13, wherein the act of providing the controller comprises providing multiple shot operation capability to the tool.

19. The method of claim 13, further comprising: providing a back-up mechanical control to actuate the tool.

20. The method of claim 13, further comprising: removing the housing and controller as a unit from the annular cavity.

21. An actuator module usable with a well, comprising:

a housing adapted to be received in an annular cavity of a tubular string;

a stimulus detector mounted to the housing to detect communication of a command-encoded stimulus downhole;

an actuator mounted to the housing to selectively control a tool of the string in response to the stimulus; and a back-up mechanical control to activate the tool.

22. A method usable with a well, comprising:

providing a housing of a string and is adapted to form a releasable connection with the string;

providing a controller attached to the housing to enable a tool of the string to respond to command-encoded stimuli; and providing a back-up mechanical control to actuate the tool.

23. A system usable with a tubular string adapted to be deployed in a well, the string comprising a segment to extend along a longitudinal axis of the string to connect a first portion of the string to a second portion of the string and define an annular cavity that at least partially surrounds the segment, the system comprising:

a tool; and an actuator module adapted to be installed in the annular cavity as a unit, the actuator module comprising a stimulus detector to detect communication of a command-encoded stimulus downhole and an actuator to selectively control the tool in response to the stimulus.

24. The system of claim 23, further comprising: additional actuator modules adapted to be installed and retrieved from the string.

* * * * *